United States Patent [19]

Bridgewater

[11] Patent Number: 4,962,750

[45] Date of Patent: Oct. 16, 1990

[54] REMOTE CONTROL OF GAS FIREPLACE BURNER

[75] Inventor: Jon D. Bridgewater, Diamond Bar, Calif.

[73] Assignee: R. H. Peterson Company, City of Industry, Calif.

[21] Appl. No.: 432,077

[22] Filed: Nov. 6, 1989

[51] Int. Cl.[5] ..... F24C 5/02; F23Q 2/32

[52] U.S. Cl. ..... 126/503; 126/512; 431/125

[58] Field of Search ..... 126/503, 512, 92 R, 126/39 BA, 540, 39 G, 39 E, 25 B; 431/125, 350, 328, 354

[56] References Cited

U.S. PATENT DOCUMENTS

| | | | |
|---|---|---|---|
| 1,048,372 | 12/1912 | Swan et al. | 431/270 |
| 2,835,830 | 5/1956 | Rathenau | 307/114 |
| 2,870,835 | 1/1959 | Lundgren | 431/46 |
| 3,363,250 | 1/1968 | Jacobson | 343/225 |
| 3,475,092 | 10/1969 | Harvey | 353/103 |
| 3,696,801 | 10/1972 | Whitehead | 126/92 R |
| 4,190,034 | 2/1980 | Wonisch | 126/25 B |
| 4,218,681 | 8/1980 | Hormann | 455/603 |
| 4,377,006 | 3/1983 | Collins et al. | 455/603 |
| 4,487,572 | 12/1984 | Parker | 126/25 B |
| 4,779,608 | 10/1988 | Smith | 126/25 B |

FOREIGN PATENT DOCUMENTS

| | | | |
|---|---|---|---|
| 2099607 | 12/1982 | United Kingdom | 126/39 BA |

*Primary Examiner*—James C. Yeung

*Attorney, Agent, or Firm*—William W. Haefliger

[57] ABSTRACT

A fireplace gas burner apparatus incorporates a provision for remotely controlled ignition. Auxiliary manual control of electrical circuitry that produces ignition is also provided.

22 Claims, 4 Drawing Sheets

2
32
32
10
40
40
46
23
45
24
49
50'
12
25
15
16
13
15
2
48
47

32
40
26
11
10
35
27
29
31
30
16a
16a
13
36
21
22
28
20
14
15
16
12
15

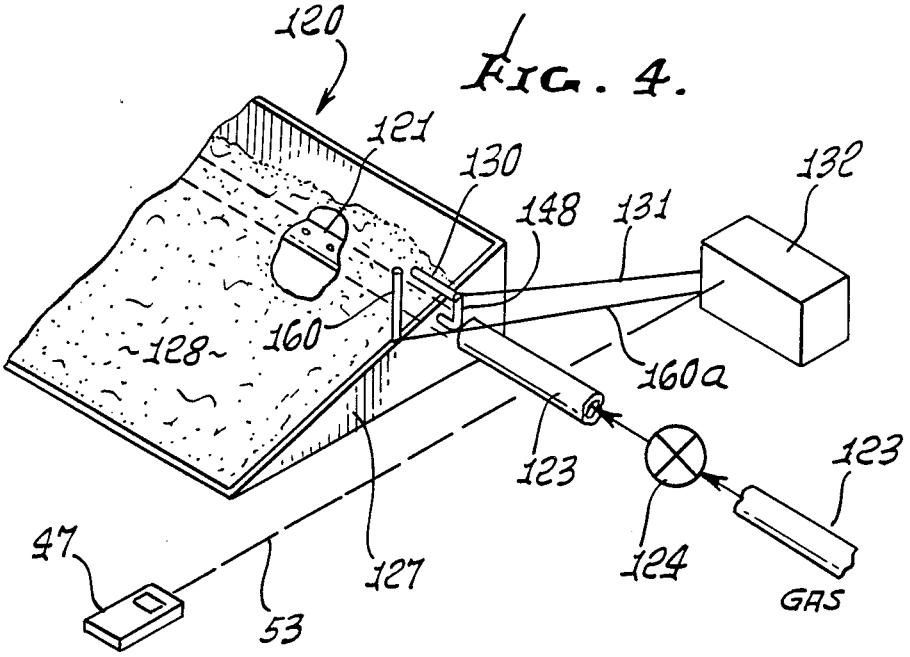
FIG. 4.
FIG. 5. (NO IGNITION)
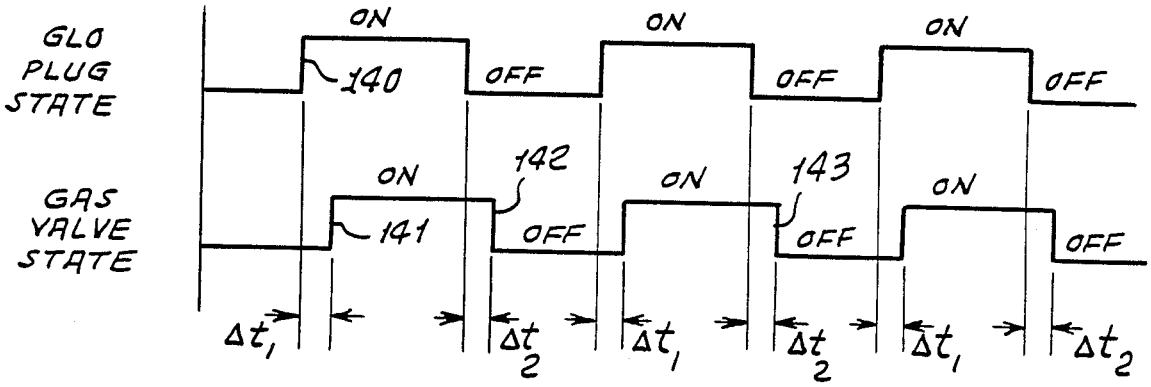
FIG. 6. (IGNITION)
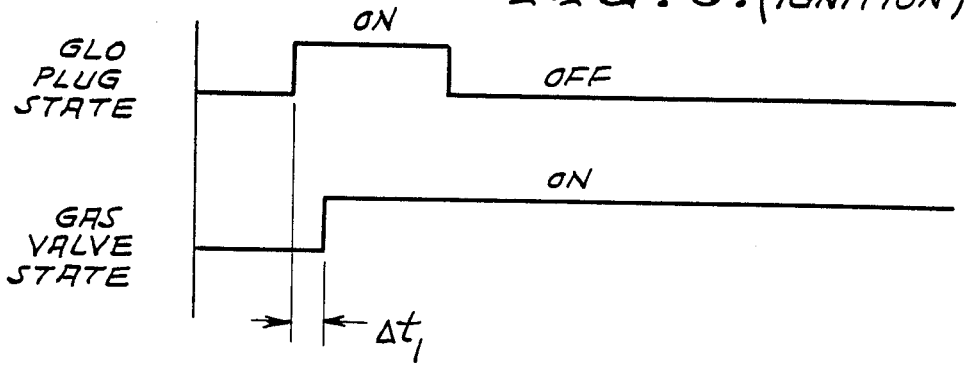

REMOTE CONTROL OF GAS FIREPLACE BURNER

BACKGROUND OF THE INVENTION

This invention relates generally to ignition of gas at the main burner of a fireplace, and more particularly, concerns remotely controlled ignition of burner gas at the fireplace.

Prior attempts to achieve remote control of fireplace gas ignition are described in U.S. Pat. Nos. 4,190,034 and 4,779,608. Neither of these enables rapid and assured gas ignition and turn-off of the main burner under control of an operator at a distance from the fireplace, as for example while the operator occupies a chair at room width, or length distance from the fireplace. There is need for apparatus which enables and assures such controlled ignition from remote locations.

SUMMARY OF THE INVENTION

It is a major object of the invention to provide efficient and reliable apparatus meeting the above need. Basically, the apparatus of the invention operates in an environment that includes an elongated main gas burner associated with a grate for supporting logs, there being a valve operatively connected with the burner to control flow of combustible gas to the burner. The apparatus comprises:

(a) first means including a main burner to produce a pilot flame for igniting gas flowing to the main burner;

(b) valve means to (i) control gas flow to the pilot burner, and (ii) control gas flow to the main burner;

(c) electrically operated control means responsive to remote transmission of RF or IR wave energy to effect flow of gas to the pilot burner by operation of the valve means, to effect operation of the first means to ignite the gas at the pilot burner, and to effect flow of gas to the main burner for ignition by the pilot flame.

As will be seen, the electrically operated control means typically includes a hand-held, remote transmitter of RF or IR.

It is another object of the invention to provide first means, as referred to, which includes a spark igniter unit operatively connected with an IR or RF wave energy receiver for igniting gas flowing to the pilot valve, in response to reception of wave energy from the transmitter. In this regard, the valve means normally includes a pilot gas valve connected with the pilot burner, and a main gas valve connected with the main burner. Also, the control means may advantageously include:

a switch for controlling opening of the main gas valve, a sensor to sense production of the pilot flame, and a circuit connected with the switch and sensor to effect opening of the main gas valve in response to such sensing of the pilot flame.

Another object is to provide fireplace gas igniting apparatus that includes (a) first means proximate the burner means for igniting gas to produce flames rising in the fireplace, (b) electrically operated control means operatively connected with the valve and with the first means, and responsive to remote transmission of RF or IR wave energy to (i) effect flow of gas to the burner means by operation of the valve, (ii) effect energization of the first means to in turn effect the ignition of gas, (iii) sense the pressure or absence of flames to be provided in response to the ignition, (iv) stop flow of gas to the burner means by operation of the valve, in response to the sensing of the absence of flames.

The burner means may then comprise one of the following:

($x_1$) an elongated burner pipe having gas discharge ports, ($x_2$) a tray and incombustible particulate in the tray to which gas is supplied to rise through the particulate.

These and other objects and advantages of the invention, as well as the details of an illustrative embodiment, will be more fully understood from the following specification and drawings in which:

DRAWING DESCRIPTION

Figure 4A:
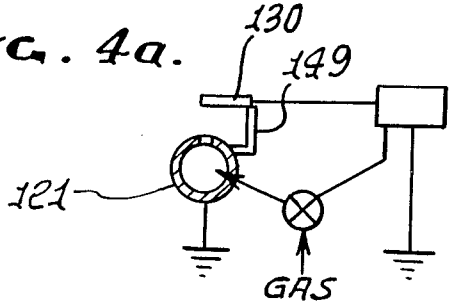
FIG. 4 is a perspective view of a fireplace and gas ignition, which is modified.
Figure 7:
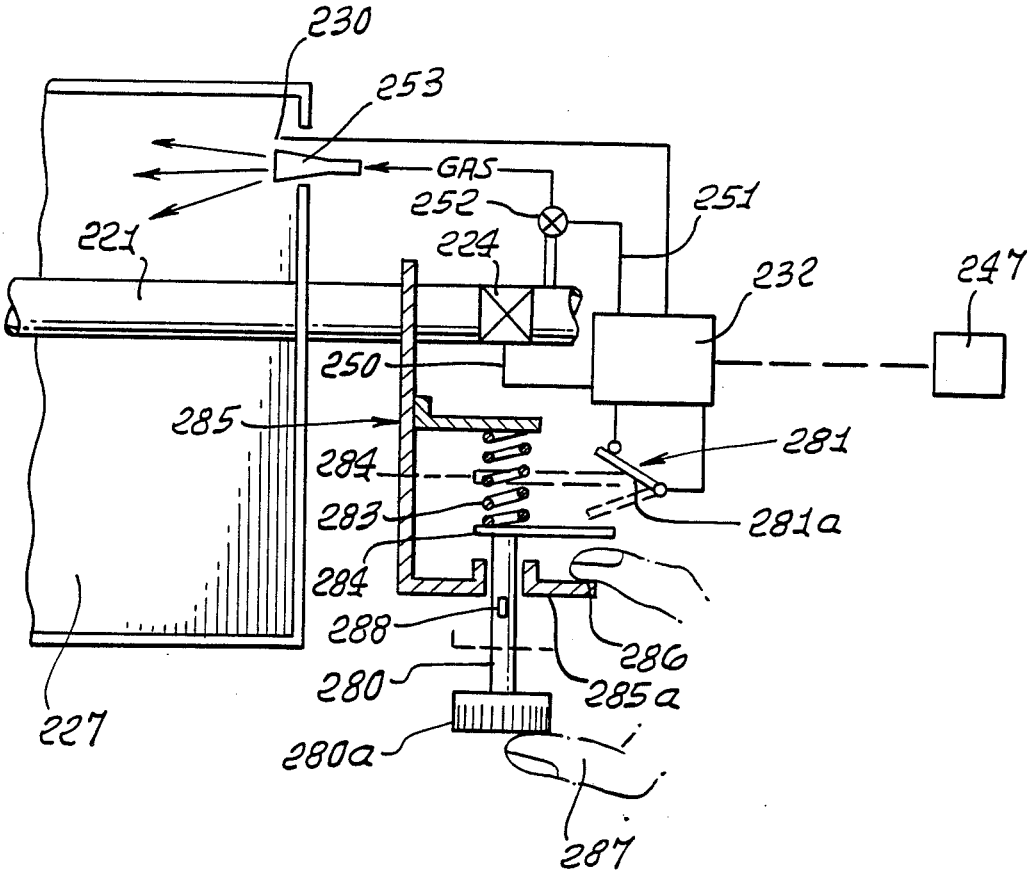

FIG. 4*a* shows an igniter clipped to a gas burner pipe;

FIGS. 5 and 6 are diagrams showing operation;

FIG. 7 is a plan view of alternate manual ignition; and

Figure 8:
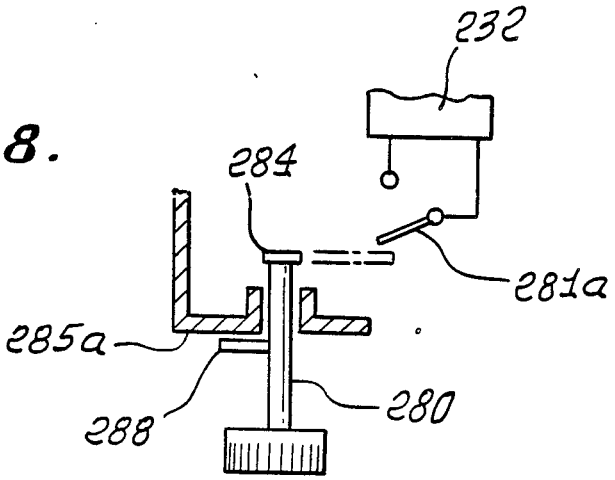

FIG. 8 is a fragmentary view showing a safety position of the FIG. 7 device.

DETAILED DESCRIPTION

Figure 1:
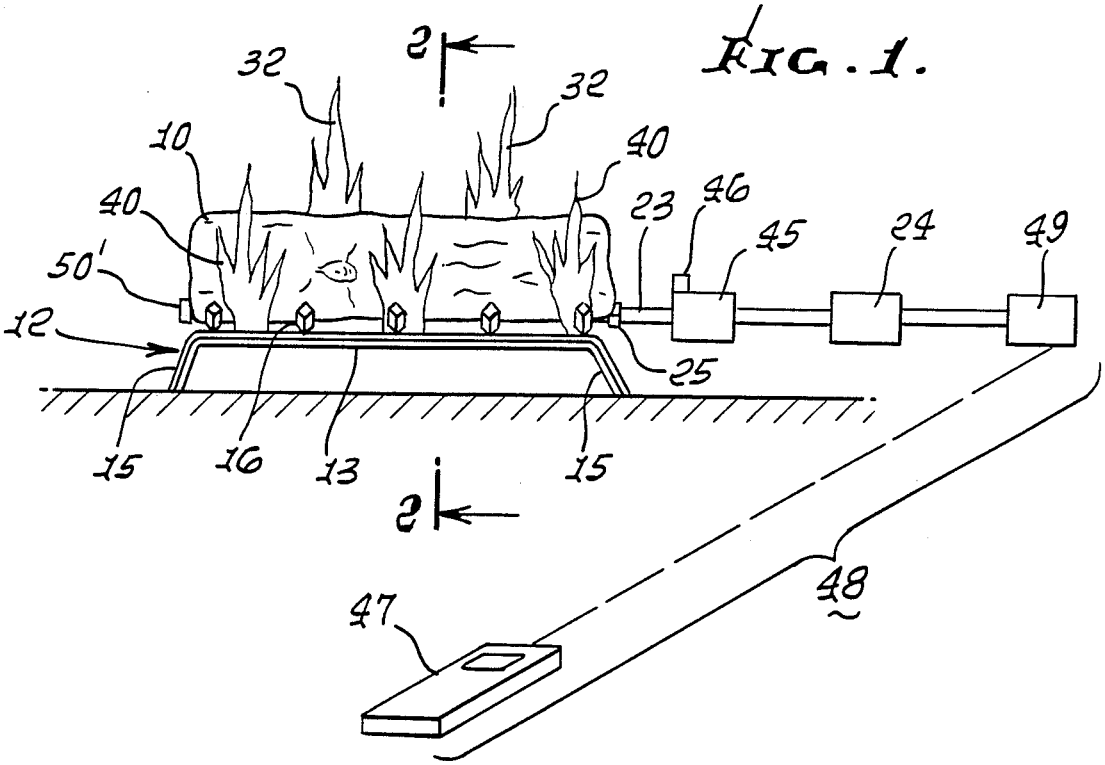
FIG. 1 is a frontal elevation of one type of fireplace with which the invention may be incorporated.
Figure 2:
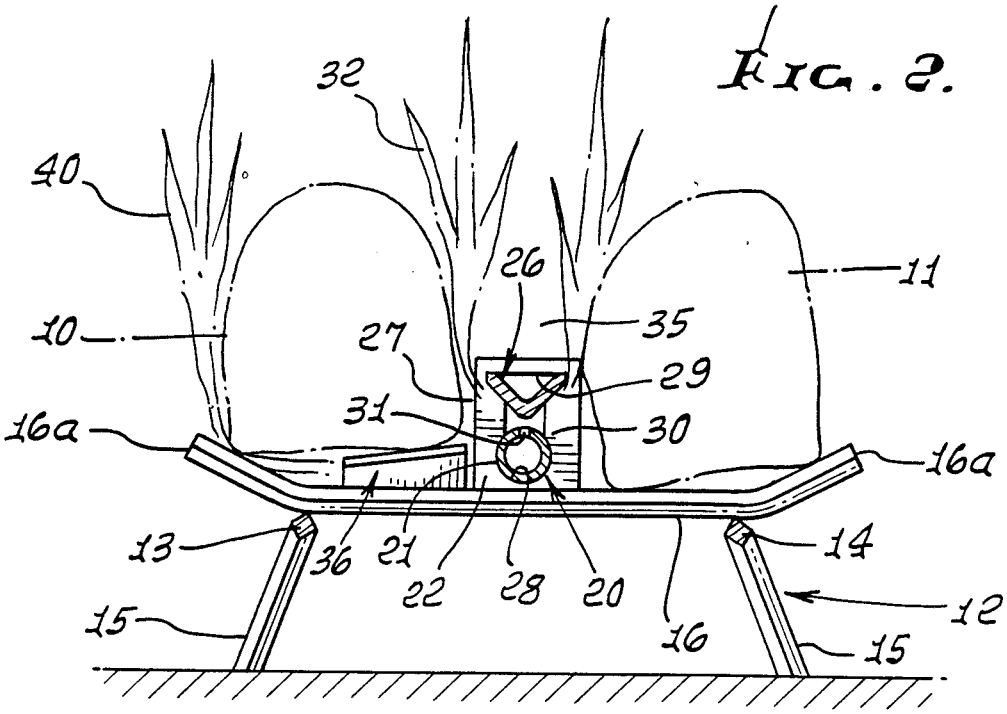
FIG. 2 is an enlarged vertical section taken on lines 2—2 of FIG. 1.

In FIGS. 1 and 2, front and rear logs 10 and 11 are carried on support structure 12 which may comprise a grate having transversely extending front and rear metal members 13 and 14. The latter are supported on legs 15, and in turn support forwardly and rearwardly extending metallic bars 16, which are transversely spaced apart and have upwardly inclined terminals 16*a*. Either or both logs 10 and 11 may consist of combustible material, such as wood, or a non-combustible material, such as refractory, ceramic, or fire resistant material, the object being that a natural log burning hearth will be simulated or created, when viewed from the front as in FIG. 1.

The combination also includes a transversely elongated gas burner carried by the support structure. As one example, the main gas burner 20 includes a duct or pipe 21 supported by mounts 22 on bars 16, and supplied with combustible gas via line 23. A valve means 24 controls gas flow to the main burner pipe, and a nut controlled air inlet 25 regulates the combustible mixture to vary the flame color. See in this regard U.S. Pat. No. 3,042,109 to Peterson. A cap 50 closes the opposite end of the pipe.

A flame deflector may be carried, for example, by the pipe to extend lengthwise thereover. The illustrated deflector 26 has V-shaped cross section as best seen in FIG. 2, and is carried by pairs of bracket arms 27. Each of the arms has a pair of openings 28 and 29 therethrough respectively to pass the burner duct and the deflector, whereby the duct carries the arms 27 which in turn may carry the deflector. Inward projections 30 formed by the arms engage the upper side of the duct, for support purposes. Gas released by upper ports 31 in the duct 21 is deflected to produce flame 32 rising at the front of the deflector, and flame 33 rising at the rear of the deflector. Note that the deflector prevents clogging of the ports 31 by catching particles that might otherwise fall into those ports. Also, the burner 20 and deflector 26 are concealed in the space 35 between the front and rear logs.

The assembly may additionally include flame chute structure extending generally frontwardly of the burner structure 20. Such chute structure may for example include multiple (i.e., two or more) metallic chutes 36, each of which is integral with a pair of bracket arms 27, as shown, providing extreme simplicity of construction. Flames from the chute means 36 rise at 40, at the front of log 10.

The application, as described so far, is illustrative of one form of fireplace with which the invention may be employed, and with unusual advantage, other forms also being usable. As referred to, it is desired that the fireplace may be turned on or off, under the control of the observer or operator located at a distance from the fireplace.

As shown in FIG. 1, first means 45, including a pilot burner 46, is provided to produce a pilot flame for igniting gas flowing to the main burner. Valve means 24 is operatively connected with the means 45 to control gas flow to the pilot burner, and to control gas flow to the main burner; and electrically operated control means is provided, as at 48, to be operatively connected with the valve means and is responsive to remote transmission of RF or IR wave energy to effect flow of gas to the pilot burner by operation of the valve means, to effect operation of the first means to ignite the gas at the pilot burner, and to effect flow of gas to the main burner for ignition by the pilot flame, in response to production of pilot flame. As shown, the control means typically includes a hand-held remote transmitter 47 of radio frequency wave energy (RF) or of infra-red wave energy (IR), and a wave energy receiver 49 operatively connected with the valve means. The transmitter-receiver of U.S. Pat. No. 4,377,006 is usable.

Figure 3:
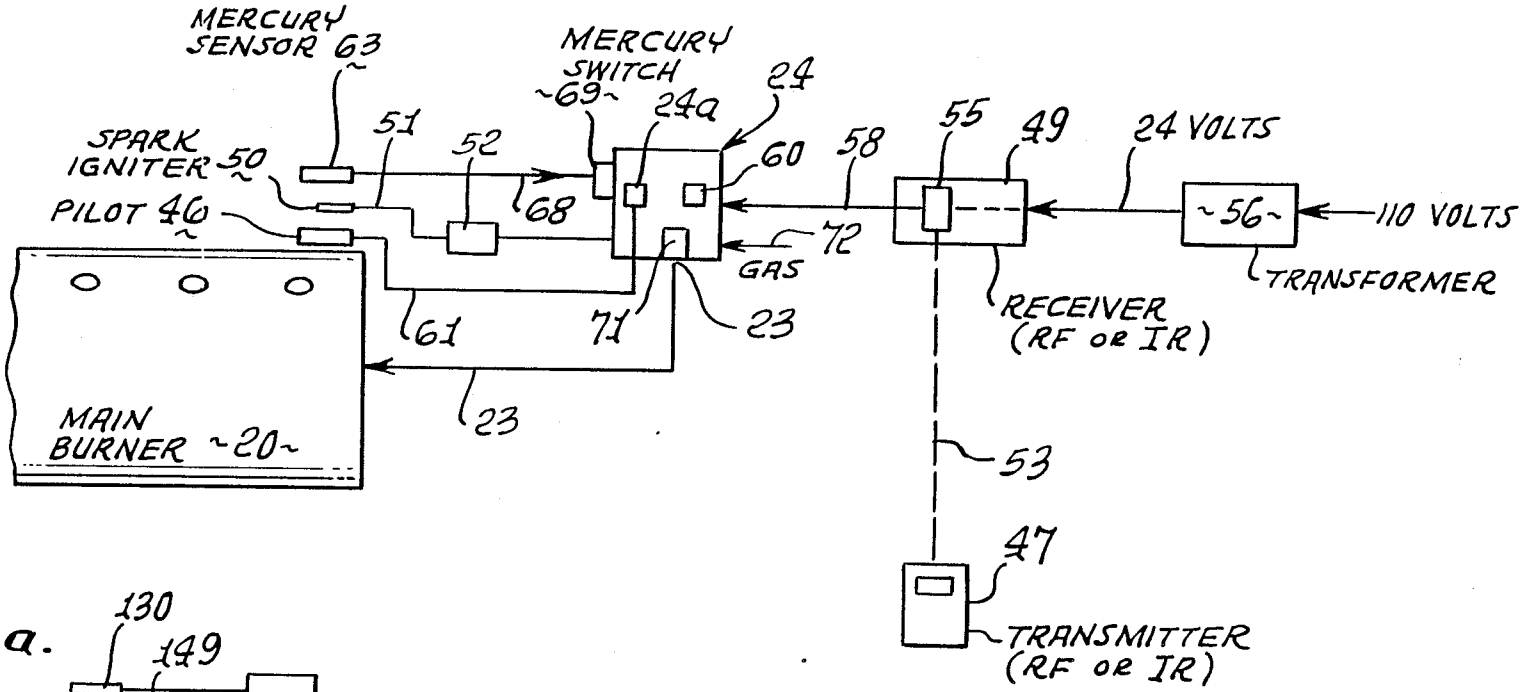
FIG. 3 is a schematic diagram showing components of the invention.

Extending the direction to FIG. 3, the first means 45 includes a spark igniter 50 adjacent the pilot burner. The igniter is connected at 51 to an igniter module 52 constructed to produce a spark or sparks at the igniter in response to reception at receiver 49 of wave energy transmitted at 53 from the transmitter. The receiver incorporates a relay 55 which temporarily closes to transmit electrical energy from a 24 volt source 56 to the module, via connection 58. One possible form of usable module 52 and igniter 50 is Model 21025, produced by White Rodgers, St. Louis, Mo.

The connector 58 also operates a solenoid 60 in the valve means 24 which opens a pilot gas valve **24*a* to deliver gas via line 61 to the pilot burner 46**. This sequence serves to produce a pilot flame at the pilot burner.

The control means also includes a sensor 63, as for example a mercury-type sensor (one example being Model 3049, produced by White Rodgers), which constitutes a transducer outputting an electrical signal on line 68 in response to heating by the pilot flame. The line 68 is connected with a relay 69 in or associated with the valve means 24, that operates to open the main gas valve 71 in the valve means 24. Gas then flows from inlet 72 to the means 24 to the outlet 23 and via line 23 to the main burner 21, for producing flames at the logs as described.

When the operator transmits a "shut down" signal via transmitter 47 to the receiver, it operates the described relays 55 and 69 for closing the gas valves 71 and **24*a*. The transmitter and receiver may, for example, take the form of Models 921** and produced by Pulsar Corp., Hendersonville, Tenn.

It will be noted that the pilot burner is advantageously located at or near the main burner 20 in the fireplace, so that unignited gas passes to the fireplace flue.

Referring to FIG. 4, fireplace burner apparatus 120 includes a duct or pipe 121 supplied with combustible gas via line 123. Valve 124, in series with line 123, controls gas flow to the pipe 121, and air may also be supplied to the pipe by means as indicated above at 25. The burner apparatus also includes a metallic tray 127, and sand or other non-combustible particulate 128 received into the tray, as for example in wedge-shape, as shown. Other forms are usable. Pipe 121 is buried in the particulate and gas escaping from the buried pipe ports disperses in the sand and rises to escape from and over the extended upper surface of the sand. If the gas ignites, the flames play and flicker as they rise from the sand upper extended surface to play on artificial logs above the tray.

First means, such as an igniter 130, extends proximate the burner means for igniting gas to produce the flames referred to. The igniter 130 is connected at 131 with an electrically operated control means 132 that is also operatively connected with the valve, and responsive to RF or IR "turn on" main energy to:

(i) effect flow of gas to the burner means by operation of the valve 124, (ii) effect energization of the first means 130 to in turn effect the ignition of gas, (iii) sense the pressure or absence of flames to be produced in response to the ignition, (iv) stop flow of gas to the burner means by operation of the valve, in response to the sensing of the absence of flames.

The igniter is adapted to be heated by electrical current from the control means 132 (as by resistance heating) to gas igniting temperature, in response to operation of the control means. The second function of the igniter is to form an electrical series circuit with the flames and the control means to test for circuit continuity and thereby maintain the valve in gas flow passing state. FIGS. 5 and 6 show the operation.

In FIG. 5, the igniter is turned on at time 140, in response to reception by 132 of a turn-on signal 53 from remote control or transmitter 47, as referred to above. After time $\Delta t_1$ (for example, about three seconds during which igniter 130 heats up) the valve 124 is turned on, at 141. Circuit continuity is then tested, and if there is no ignition of gas by 130, there is no flame, and there is no circuit continuity.

The circuit includes a return lead 160 extending near the igniter in the flame region, and back to the means 132, via lead extent **160*a*. The control 132 senses absence of continuity, and thus deenergizes the igniter at 142, and also turns off the valve at 143 (for example after $\Delta t_2$, i.e., about one second after 142). Such "cycling" (attempts at gas ignition) are repeated, as for example three times as seen in FIG. 5, after which the control 132** shuts down or deactivates if ignition still fails.

In FIG. 6, if "continuity" is sensed by 132, the igniter 130 is shut down as at 143, but the valve 127 is maintained open, to supply gas to the burner apparatus, above which flames now rise.

The igniter 130 may be clipped or otherwise attached to the tray 120, as by mounting means 148. FIG. 4*a* shows a similar arrangement with the igniter clipped at 149 to a gas burner pipe 121. No "return" lead is needed, as grounded metal pipe 121 serves this purpose, in this instance.

Referring now to FIG. 7, it shows an electrically operated control means 232 for controlling (at 250) a main gas valve 224 in series with burner pipe 221 projecting horizontally in tray 227 (like tray 127). The means 232 also controls (at 251) pilot gas flow via pilot valve 252 to the pilot burner 253. The control means also produces high voltage flow to the igniter tip at 230 for effecting production of sparks that pass to the electrically grounded pilot burner for igniting the pilot flame (that in turn ignites the flow of gas from the main burner). In this regard, the control means is typically responsive to the turn-on signal at 253 from a remote transmitter 247, as before.

An alternate turn-on apparatus includes a manual control, such as plunger 280, adapted to be manually displaced to effect closing of a switch 281 associated with the control means 232, thereby turning on the control means (as does signal 253). Spring 283 normally urges the plunger into FIG. 7 position. Plate 284 on plunger engages switch arm 281*a* as the plunger moves forwardly. A frame or bracket 285 on pipe 221 has an arm or part 285*a* that can be finger grasped at 286 as the plunger knob 280*a* is pushed forwardly by the user's thumb 287.

In FIG. 8, the plunger 280 has been rotated 90° to rotate plate 284 upwardly, out of position to engage the switch arm. This is the safety position of the manual plunger and its knob. Tang 288 on the plunger is then rotated to engage the bracket part 285*a* and block forward displacement of the plunger.

I claim:

1. In an apparatus to light a fireplace that includes an elongated main gas burner associated with a grate for supporting logs, there being a valve operatively connected with the burner to control flow of combustible gas to the burner, the combination comprising:

(a) first means including a pilot burner to produce a pilot flame for igniting gas flowing to the main burner;

(b) valve means operatively connected with the first means to (i) control gas flow to said pilot burner and (ii) control gas flow to said main burner;

(c) electrically operated control means responsive to remote transmission of RF or IR wave energy to effect flow of gas to said pilot burner by operation of said valve means, to effect operation of said first means to ignite said gas at said pilot burner, and to effect flow of gas to said main burner for ignition by said pilot flame in response to production of pilot flame, (d) and an electrical continuity sensor circuit means operatively connected with said first means and with said electrically operated control means for sensing the existence of absence of flame, for controlling repeated attempts to ignite gas flowing to the pilot burner.

2. The combination of claim 1 wherein said electrically operated control means includes a hand-held remote transmitter of RF or IR.

3. The combination of claim 2 wherein said control means includes a receiver proximate the fireplace and operatively connected to said first means and said valve means to effect said operations of the valve means and first means in response to reception of said wave energy from the transmitter.

4. The combination of claim 1 wherein said first means includes a spark igniter unit for igniting gas flowing to the pilot valve.

5. The combination of claim 3 wherein said first means includes a spark igniter unit operatively connected with the receiver for igniting gas flowing to the pilot valve in response to said reception by the receiver of wave energy from the transmitter.

6. The combination of claim 1 wherein said valve means includes a pilot gas valve connected with the pilot burner, and a main gas valve connected with the main burner.

7. The combination of claim 6 wherein said control means includes:

a switch for controlling opening of the main gas valve, a sensor to sense production of the pilot flame, and a circuit connected with said switch and sensor to effect said opening of the main gas valve in response to said sensing of the pilot flame.

8. The combination of claim 5 wherein said valve means includes a pilot gas valve connected with the pilot burner and a main gas valve connected with the main burner.

9. The combination of claim 8 wherein said control means includes:

a switch for controlling opening of the main gas valve, a sensor to sense production of the pilot flame, and a circuit connected with said switch and sensor to effect opening of the main gas valve in response to said sensing of the pilot flame.

10. In apparatus to ignite gas at fireplace burner means associated with grate for supporting logs or simulated logs, there being a valve operatively connected with the burner means to control flow of combustible gas to the burner means, the combination comprising:

(a) first means proximate the burner means for igniting gas to produce flames rising in the fireplace, (b) electrically operated control means operatively connected with the valve and with said first means, and responsive to remote transmission of RF or IR wave energy to (i) effect flow of gas to the burner means by operation of the valve, (ii) effect energization of said first means to in turn effect said ignition of gas, (iii) repeatedly sense for the presence or absence of flames to be produced in response to said ignition, (iv) stop flow of gas to the burner means by operation of the valve, in response to said repeated sensing for the absence of flames.

11. The combination of claim 10 wherein said burner means comprises one of the following:

($x_1$) an elongated burner pipe having gas discharge ports, ($x_2$) a tray and incombustible particulate in the tray to which gas is supplied to rise through the particulate.

12. The combination of claim 10 wherein said first means comprises an electrically energizable igniter adapted to be heated by electrical current to gas igniting temperature in response to operation of said control means.

13. The combination of claim 12 including means mounting said igniter to said burner apparatus to extend in the path of flame rising from said burner apparatus.

14. The combination of claim 13 wherein said igniter forms an electrical series circuit with said flames and said control means to heat in circuit continuity and thereby maintain the valve in gas flow passing state.

15. The combination of claim 10 including a manual control coupled to said control means, and responsive to manual actuation of said manual control to effect operation of said electrically operated control means.

16. The combination of claim 15 wherein said electrically operated control means includes an electrical switch, and said manual control includes a plunger adapted to be manually displaced to effect operation of the switch.

17. The combination of claim 16 including frame structure associated with the plunger, and a part on the frame structure positioned to be manually grasped as the plunger is displaced toward said part to operate the switch.

18. The combination of claim 17 wherein the plunger is rotatable between a first position in which it can be pushed toward the switch, and a second position in which it is blocked against displacement toward the switch.

19. In apparatus to ignite gas at fireplace burner means associated with grate for supporting logs or simulated logs, there being a valve operatively connected with the burner means to control flow of combustible gas to the burner means, the combination comprising:

(a) first means proximate the burner means for igniting gas to produce flames rising in the fireplace, (b) electrically operated control means operatively connected with the valve and with said first means to:

(i) effect flow of gas to the burner means by operation of the valve, and to (ii) effect energization of said first means, (c) a manual control coupled to said control means, and responsive to manual actuation of said manual control to effect operation of said electrically operated control means, (d) and an electrical continuity sensor circuit means operatively connected with said first means and with said electrically operated control means for sensing the existence or absence of flame, for controlling repeated attempts to ignite gas flowing to the burner.

20. The combination of claim 19 wherein said electrically operated control means includes an electrical switch, and said manual control includes a plunger adapted to be manually displaced to effect operation of the switch.

21. The combination of claim 20 including frame structure associated with the plunger, and a part on the frame structure positioned to be manually grasped as the plunger is displaced toward said part to operate the switch.

22. The combination of claim 21 wherein the plunger is rotatable between a first position in which it can be pushed toward the switch, and a second position in which it is blocked against displacement toward the switch.

* * * * *